US011647815B2

(12) United States Patent
Weng

(10) Patent No.: US 11,647,815 B2
(45) Date of Patent: May 16, 2023

(54) MAGNETIC BUCKLE DEVICE

(71) Applicant: Renny Tse-Haw Ling, Taipei (TW)

(72) Inventor: Chia-Wei Weng, Taipei (TW)

(73) Assignee: Sinox Company Ltd., New Taipei (TW)

( * ) Notice: Subject to any disclaimer, the term of this patent is extended or adjusted under 35 U.S.C. 154(b) by 0 days.

(21) Appl. No.: 17/692,320

(22) Filed: Mar. 11, 2022

(65) Prior Publication Data

US 2022/0295947 A1 Sep. 22, 2022

(30) Foreign Application Priority Data

Mar. 17, 2021 (TW) ..... 110109558

(51) Int. Cl.
*A44B 11/25* (2006.01)
*A44B 19/30* (2006.01)

(52) U.S. Cl.
CPC ..... *A44B 11/2584* (2013.01); *A44B 19/301* (2013.01); *A44D 2203/00* (2013.01)

(58) Field of Classification Search
CPC . A44B 19/301; A44B 11/2584; A44B 11/258; A44D 2203/00; A45C 13/103; A45C 13/1069
See application file for complete search history.

(56) References Cited

U.S. PATENT DOCUMENTS

| | | | | |
|---|---|---|---|---|
| 10,034,521 | B1 * | 7/2018 | Miller | A44B 19/301 |
| 10,874,178 | B2 | 12/2020 | Cheng | |
| 2009/0106951 | A1 * | 4/2009 | Edwards | A44B 19/301 24/399 |
| 2019/0110559 | A1 * | 4/2019 | Chen | A44B 19/301 |
| 2020/0022468 | A1 * | 1/2020 | Song | A44B 19/301 |

FOREIGN PATENT DOCUMENTS

| | | | |
|---|---|---|---|
| CN | 101646362 | A | 2/2010 |
| DE | 102017212152 | A1 | 1/2019 |
| EP | 2436280 | A1 | 4/2012 |

* cited by examiner

*Primary Examiner* — Robert Sandy
(74) *Attorney, Agent, or Firm* — Rosenberg, Klein & Lee

(57) ABSTRACT

A magnetic buckle device has a buckle main body and an inserting head. When the inserting head is close to an insertion hole of the buckle main body, the magnetic attraction force between a first component on the inserting head and a second component on the buckle main body can assist with inserting the inserting head into the insertion hole. After the inserting head is inserted to a predetermined position, the magnetic attraction force will keep the buckle main body in an engaged state even without any additional fixing means. When the buckle main body is switched to a disengaged state and the inserting head is moved out of the buckle main body, the magnetic attraction force attracts the inserting head to attach to the buckle main body, and thereby, after moved out, the inserting head cannot move arbitrarily.

11 Claims, 19 Drawing Sheets

MAGNETIC BUCKLE DEVICE

BACKGROUND OF THE INVENTION

1. Field of the Invention

The present invention relates to a buckle device, especially to a buckle device that is utilized to a bag, a backpack, a suitcase, etc. The buckle device is detachably connected to two components and can be applied to various locks.

2. Description of the Prior Arts

Conventionally, bags or suitcases are opened and closed via a zipper. Some of them (especially a suitcase) have a buckle device. The zipper head of the zipper may be inserted into the buckle device such that the zipper head is fixed and cannot be moved, thereby locking the suitcase.

However, the conventional buckle device has the following defects: to insert the zipper head into the buckle device, the user has to align the zipper head with an insertion hole of the buckle device, and then press the zipper head into the insertion hole of the buckle device with adequate force, which is not convenient. Especially, when the user wants to lock a suitcase, the user's hands may be occupied, and thus the buckle device is hard to be locked.

Besides, after the conventional buckle device is unlocked, the zipper head is released and then moves arbitrarily. Therefore, when the user wants to lock the conventional buckle device again, the user has to find the zipper head first and fix it, which is inconvenient.

The various conventional locks which are fixed via buckling have the same defects. Before locking, the user has to align the inserting head to a correct position, and exert quite a lot of force to insert the inserting head. Similarly, after the lock which is fixed via buckling is unlocked, the inserting head may move arbitrarily, too.

To overcome the shortcomings, the present invention provides a magnetic buckle device to mitigate or obviate the aforementioned problems.

SUMMARY OF THE INVENTION

The main objective of the present invention is to provide a magnetic buckle device that can be engaged and locked more easily.

The magnetic buckle device may have a buckle main body, a first component, and a second component. The buckle main body has an engaged state and a disengaged state. The inserting head is configured to be inserted into the buckle main body along an engaging direction such that the buckle main body enters the engaged state. When the buckle main body is switched to the disengaged state, the buckle main body is capable of moving the buckle main body out of the inserting head. The first component is mounted on the inserting head. The second component is mounted on the buckle main body. When the inserting head is inserted into the buckle main body along the engaging direction, a magnetic attraction force is generated between the first component and the second component to assist in keeping the buckle main body in the engaged state. When the buckle main body is switched to the disengaged state and moves the inserting head out of the buckle main body, the inserting head is attached onto the buckle main body by the magnetic attraction force between the first component and the second component.

Another magnetic buckle device may have a buckle main body, a first component, a second component, and a third component. The buckle main body has an engaged state and a disengaged state. The inserting head is configured to be inserted into the buckle main body along an engaging direction such that the buckle main body enters the engaged state. When the buckle main body is changed to the disengaged state, the buckle main body is capable of moving the buckle main body out of the inserting head. The first component is mounted on the inserting head. The second component is mounted on the buckle main body. When the inserting head is inserted into the buckle main body along the engaging direction, a magnetic attraction force is generated between the first component and the second component to assist in keeping the buckle main body in the engaged state. The third component is mounted on the buckle main body. When the buckle main body is switched to the disengaged state such that the inserting head is moved out of the buckle main body, a magnetic attraction force is formed between the first component and the third component to attach the inserting head to the buckle main body.

One of the advantages of the present invention is that: when the inserting head (e.g. a zipper head) is close to an insertion hole of the buckle main body, the magnetic attraction force between the first component on the inserting head and the second component the buckle main body provides a guiding effect. Therefore, the inserting head is capable of getting further closer to the insertion hole of the buckle main body to be inserted into the insertion hole, which assists in inserting the inserting head. Then, after the inserting head is inserted to a predetermined position, the magnetic attraction force between the first component and the second component can assist with keeping the buckle main body in the engaged state. Therefore, the magnetic buckle device may not have too many fixing structures so a user may exert less force, or even no force at all, to the magnetic buckle device, and the inserting head is positioned by the magnetic attraction to engage.

Besides, when the buckle main body is switched to the disengaged state and the inserting head is moved out of the buckle main body, the magnetic attraction force between the first component and the second component or between the first component and the third component on the buckle main body can attract the inserting head to attach to the buckle main body, which prevents the inserting head, after moved out, form moving arbitrarily. Therefore, the user does not have to find the inserting head to lock.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
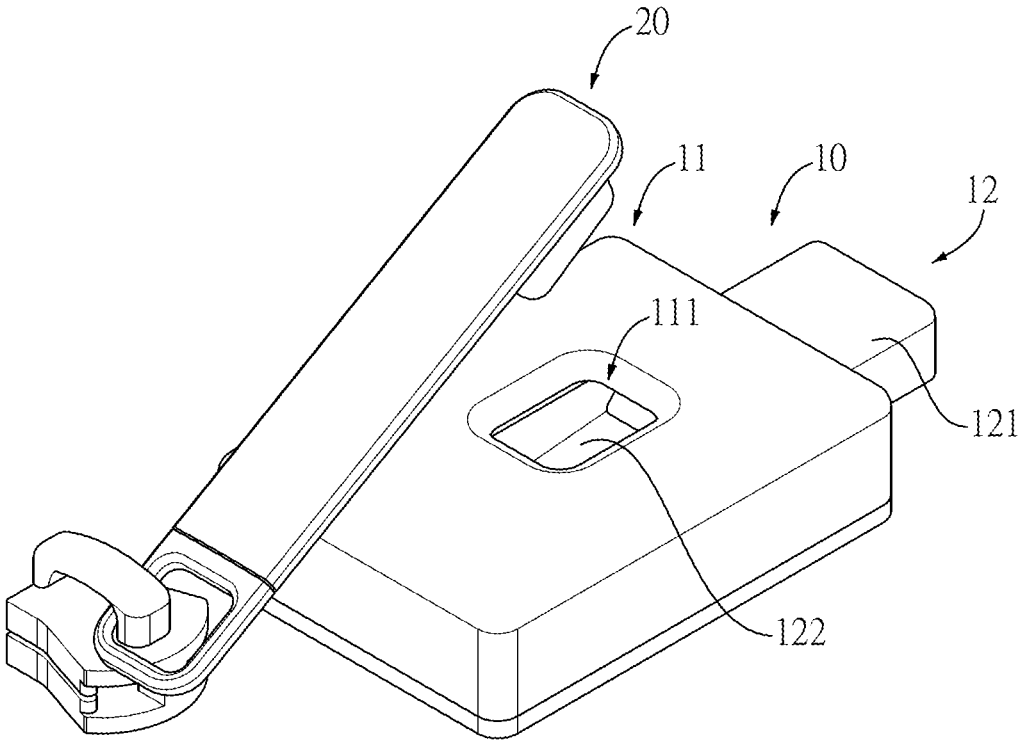
FIG. 1 is a perspective view of a magnetic buckle device in accordance with a first embodiment of the present invention.
Figure 2:
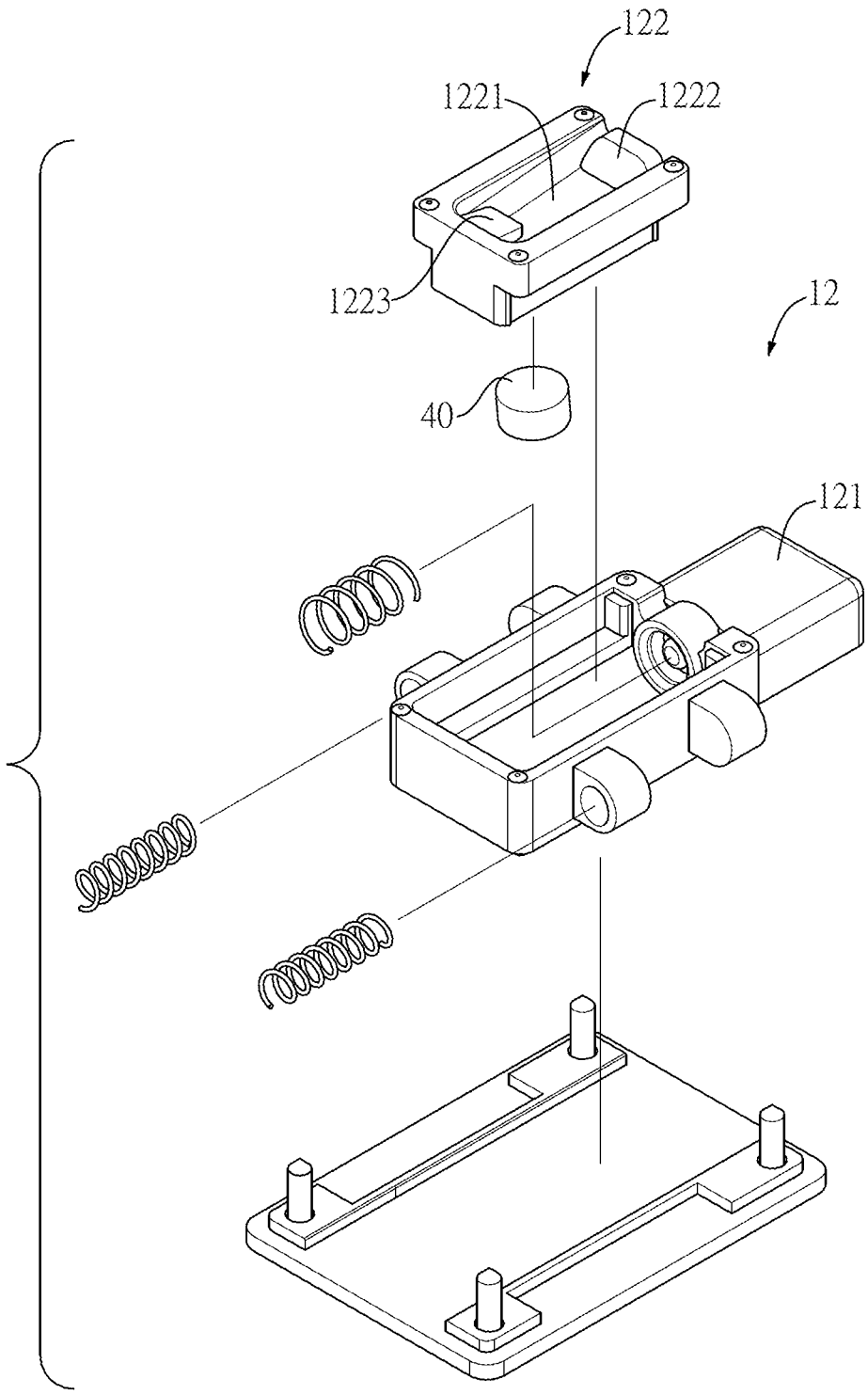
FIG. 2 is an exploded view of parts of the first embodiment of the magnetic buckle device in FIG. 1.

A magnetic buckle device in accordance with the present invention is provided. The magnetic buckle device comprises a buckle main body and an inserting head. The buckle main body has an engaged state and a disengaged state. The inserting head is configured to be inserted into the buckle main body along an engaging direction such that the buckle main body enters the engaged state. When the buckle main body is switched to the disengaged state, the buckle main body can move the inserting head out of the buckle main body. The magnetic buckle device of the present invention may be a buckle device applied to a bag, a backpack, a suitcase, etc. and the magnetic buckle device of the present invention may be a lock of any type.

The magnetic buckle device of the present invention further comprises a first component and a second component. The first component is mounted on the inserting head. The second component is mounted on the buckle main body. When the inserting head is inserted into the buckle main body along the engaging direction, a magnetic attraction force is generated between the first component and the second component to assist in keeping the buckle main body in the engaged state.

One of the first component and the second component may be a magnet and the other one is metal, or both of them are magnets, as long as the magnetic attraction force is generated therebetween.

Besides, each one of the first component and the second component may be an individual component or may be formed integrally with the corresponding component where it is mounted. For example, the first component may be formed integrally with the inserting head and the inserting head is made of magnet or metal; the second component may be formed integrally with a portion of the buckle main body that is mounted with the second component (e.g. a displacement component hereinafter), and the portion (e.g. a displacement component) of the buckle main body that is mounted with the second component is made of magnet or metal.

When the buckle main body is switched to the disengaged state and moves the inserting head out of the buckle main body, the inserting head can be attached to the buckle main body. To achieve such function, the present invention provides two configurations as follows:

Attraction by the second component: when the buckle main body is switched to the disengaged state and moves the inserting head out of the buckle main body, the magnetic attraction force between the first component and the second component attracts the inserting head to attach to the buckle main body, as shown in the first embodiment of the present invention (see FIG. 1 to FIG. 5). In other words, the second component provides two effects at the same time. When the inserting head is inserted into the buckle main body, the second component on the buckle main body can attract the inserting head to assist in keeping the buckle main body in the engaged state; after the inserting head is moved out of the buckle main body, the second component can attract the inserting head to attach to the buckle main body.

Attraction by a third component: the magnetic buckle device further comprises a third component. The third component is mounted on the buckle main body at a location that differs from that of the second component. When the buckle main body is switched to the disengaged state and moves the inserting head out of the buckle main body, a magnetic attraction force is generated between the first component and the third component to attract the inserting head to attach to the buckle main body, as shown in the second embodiment to the sixth embodiment (see FIG. 6 to FIG. 20).

Similarly, one of the first component and the third component may be a magnet and the other one is metal, or both of them are magnets, as long as the magnetic attraction force is generated therebetween. Besides, the third component may be an individual component or may be formed integrally with the corresponding component where it is mounted. For example, the third component may be formed integrally with a portion of the buckle main body that is mounted with the third component (e.g. a displacement component or a base body), and the portion (e.g. a displacement component or a base body) of the buckle main body that is mounted with the third component is made of magnet or metal.

In a preferred embodiment, the buckle main body has a first seat and a second seat combined together. The first seat comprises an insertion hole. The inserting head is capable of being inserted through the insertion hole of the first seat along the engaging direction and into the second seat, and thereby the buckle main body enters the engaged state. The second component is mounted on the second seat. The first seat and the second seat are capable of moving with respect to each other such that the buckle main body is switched to the disengaged state as shown in the first embodiment to the third embodiment (see FIG. 1 to FIG. 9). Or, the first seat and the second seat are capable of rotating with respect to each other such that the buckle main body is switched to the disengaged state as shown in the fourth embodiment to the sixth embodiment (see FIG. 10 to FIG. 20). In the disengaged state, the magnetic attraction force between the first component and the second component or the first component and the third component can attract the inserting head to attach to the first seat.

The aforementioned first seat preferably is a shell or an upper lid and the second seat preferably is a sliding seat or a bottom seat mounted on the shell, in the shell, or under the upper lid. However, when the buckle main body is switched to the disengaged state, the user may leave the first seat (i.e.

the shell) unmoved but operate (e.g. move or rotate) the second seat (i.e. the sliding seat) as shown in the first embodiment to the third embodiment (see FIG. 1 to FIG. 9). Besides, the user may leave the second seat (i.e. bottom seat) unmoved but operate (e.g. move or rotate) the first seat (i.e. the upper lid) instead, as shown in the fourth embodiment to the sixth embodiment (see FIG. 10 to FIG. 20). The structures of the first seat, the second seat, and the transmission means (through moving or rotating) are not limited thereto.

In the configuration featuring attraction by a third component, the third component may be mounted on the first seat or on the second seat. If mounted on the first seat, the third component may be located on an outer surface of the first seat and said outer surface is away from the second seat, as shown in the fourth embodiment (see FIG. 10 to FIG. 18); the third component may be located on an inner surface of the first seat and said inner surface faces the second seat, as shown in the third embodiment (see FIG. 7 to FIG. 9) and the fifth embodiment (see FIG. 19). As the third component is mounted on the second seat as shown in the second embodiment (see FIG. 6) and the sixth embodiment (see FIG. 20), if the second component is also mounted on the second seat, the third component may be located at a position where the second component is moved or rotated. Therefore, the inserting head is attached to the second component selectively, but after the second seat is moved or rotated, the inserting head is attached to the third component, which is located at a remoter position along the moving or rotating direction.

When the buckle main body is switched to the disengaged state, the inserting head is obliquely moved out of the buckle main body, then the magnetic attraction force between the first component and the second component or between the first component and the third component attracts the inserting head to attach to the buckle main body, which prevents the inserting head from insertion into the buckle main body again after moved out and assists in attracting the inserting head via the second component or the third component.

The following details are about the inserting head obliquely moved out. In a preferred embodiment, when the first seat and the second seat are moved or rotated with respect to each other, thereby switching the buckle main body to the disengaged state, a force is generated by the second seat to make the inserting head obliquely move out of the buckle main body.

Said force generated by the second seat may resist the magnetic attraction force between the first component and the second component, such that a side of the inserting head is tilted up and thereby an angle between the first component and the second component is changed. At this time, the magnetic force between the first component and the second component is unbalanced, which makes the oblique inserting head unstable. With the first seat and the second seat being pushed or rotated further, the magnetic attraction force from the first component of the second seat keeps attracting the unstable inserting head, which generates a moment on the oblique inserting head. Then, the inserting head is moved out of the first seat via the cooperation of the moment from the magnetic attraction force and the force from the second seat being pushed or rotated. In other words, the push force facilitates to move the inserting head out of the first seat.

The following details are about the force generated by the second seat to obliquely move the inserting head out of the buckle main body. In this embodiment, the second seat has an abutting surface. The abutting surface has a tilting-abutting portion protruding therefrom. In this embodiment, the tilting-abutting portion may be a bump with an inclined surface, but the shape is not limited thereto. When the first seat and the second seat are moved or rotated, the tilting-abutting portion pushes a side of the inserting head, which generates the push force to tilt up said side of the inserting head and changes the angle between the first component and the second component. However, it is not limited thereto, and the push force may be generated by other means.

Figure 7:
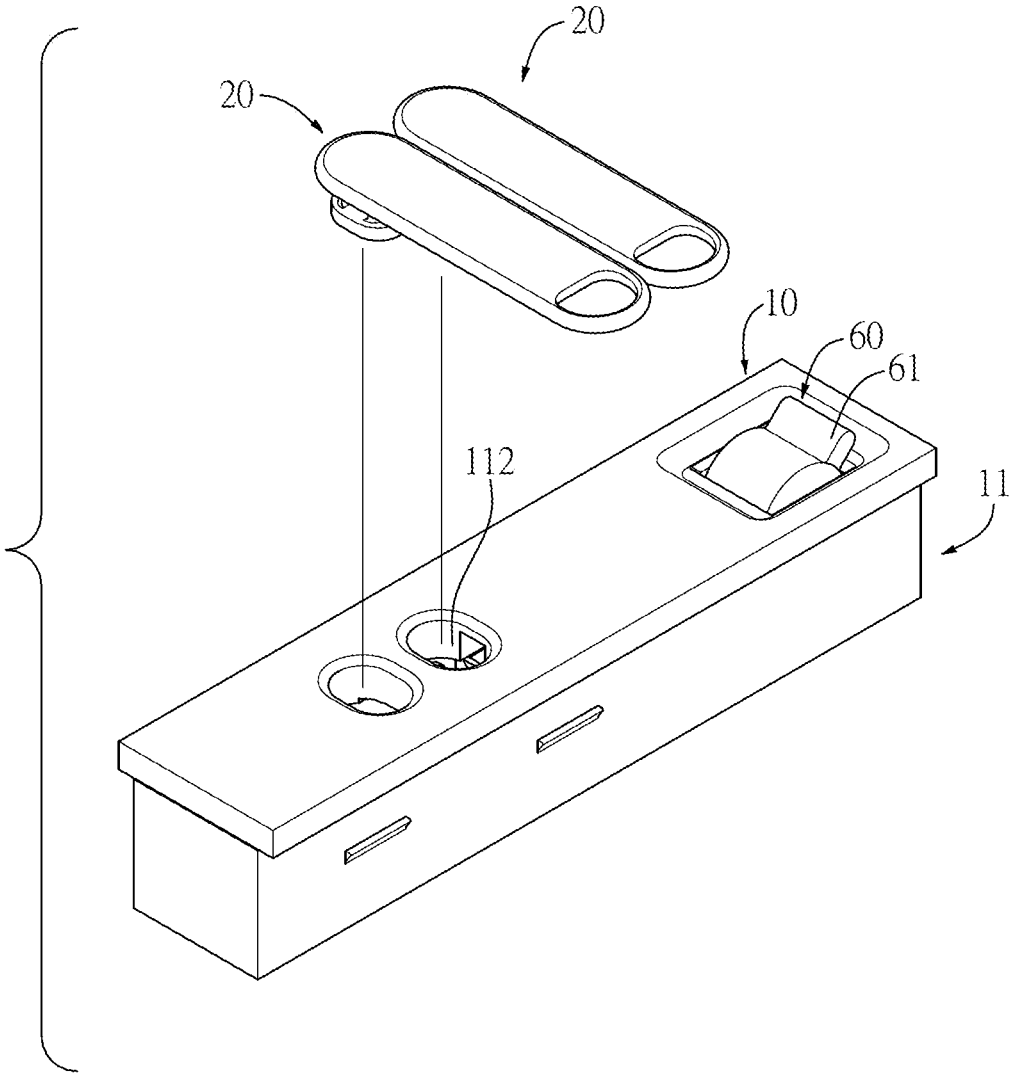
FIG. 7 is a perspective view of a magnetic buckle device in accordance with a third embodiment of the present invention.
Figure 8:
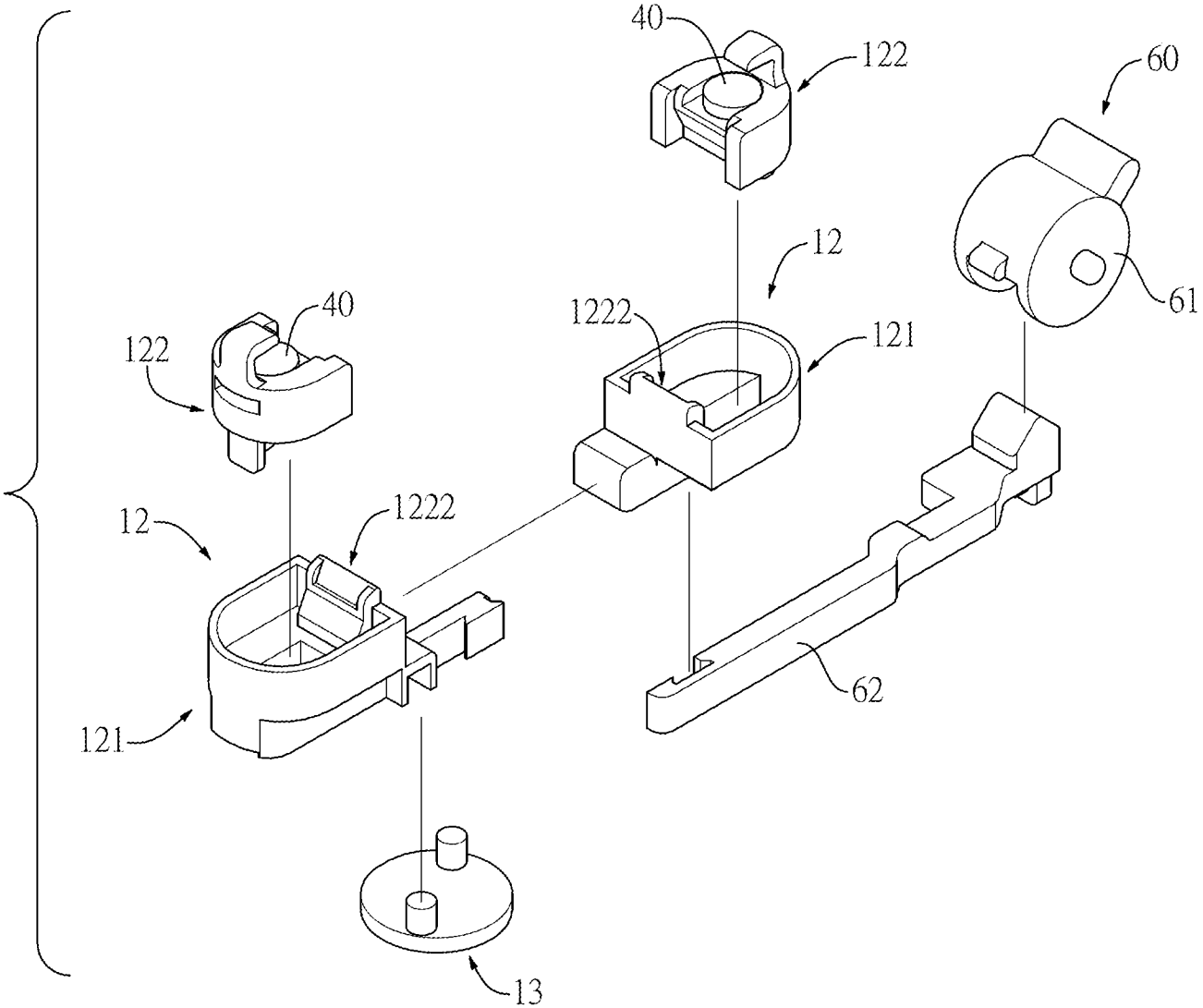
FIG. 8 is an exploded view of parts of the third embodiment of the magnetic buckle device in FIG. 7.
Figure 9:
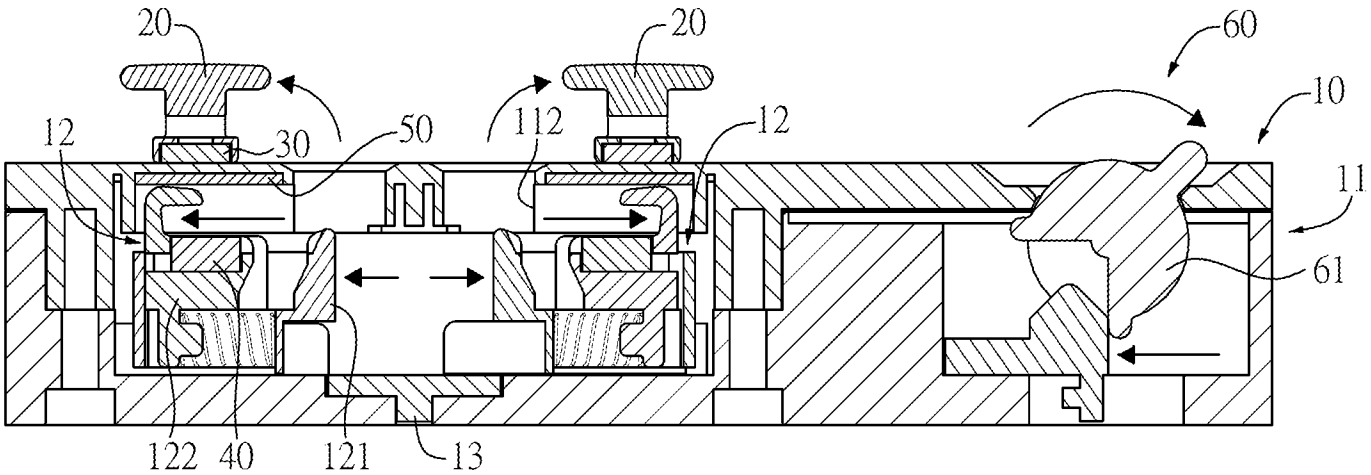
FIG. 9 is a lateral and sectional view of the third embodiment of the magnetic buckle device in FIG. 7.
Figure 10:
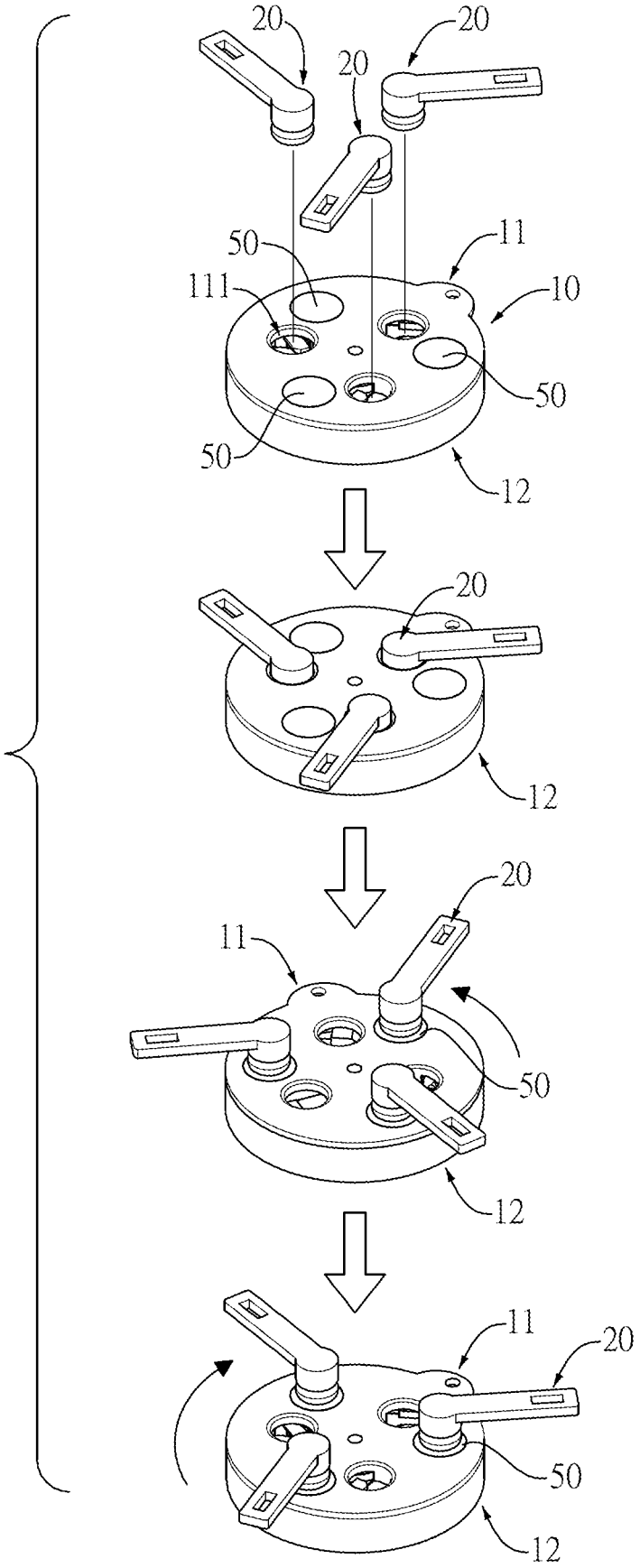
FIG. 10 is an operational view of a magnetic buckle device in accordance with a fourth embodiment of the present invention.

Finally and preferably, the first seat has a stopping portion. When the first seat and the second seat are moved or rotated with respect to each other such that the buckle main body is switched to the disengaged state, the stopping portion abuts the inserting head along with the moving or rotating of the first seat and the second seat. In the case that the second seat is kept static but the first seat is moved or rotated, the first seat facilitates to move or rotate the inserting head, as shown in the fourth embodiment (FIG. 10 to FIG. 18). In the case that the first seat is kept static but the second seat is moved or rotated, the stopping portion may prevent the inserting head from moving or rotating along with the second seat, which prevents the inserting head from moving synchronously but moving out completely after cumulating energy for a while and thereby looks like that the inserting head is popped out as shown in the third embodiment (FIG. 7 to FIG. 9).

Please refer to FIG. 1 to FIG. 5. The first embodiment of the magnetic buckle device of the present invention is in a configuration that unlocks via moving and is attracted by the second component. In the first embodiment, the buckle main body 10 includes a first seat 11 and a second seat 12. The first seat 11 may be a shell and the second seat 12 may be a sliding seat mounted in the shell. The second seat 12 may further include a base body 121 and a displacement component 122. The base body 121 is a portion of the second seat 12 and said portion is configured to be pushed by the user. The displacement component 122 is movably mounted in the base body 121. The displacement component 122 is a portion of the second seat 12 and said portion corresponds to the inserting head 20. The second component 40 is mounted on the displacement component 122 and the aforementioned abutting surface 1221 and tilting-abutting portion 1222 are both formed on the displacement component 122.

Figure 3:
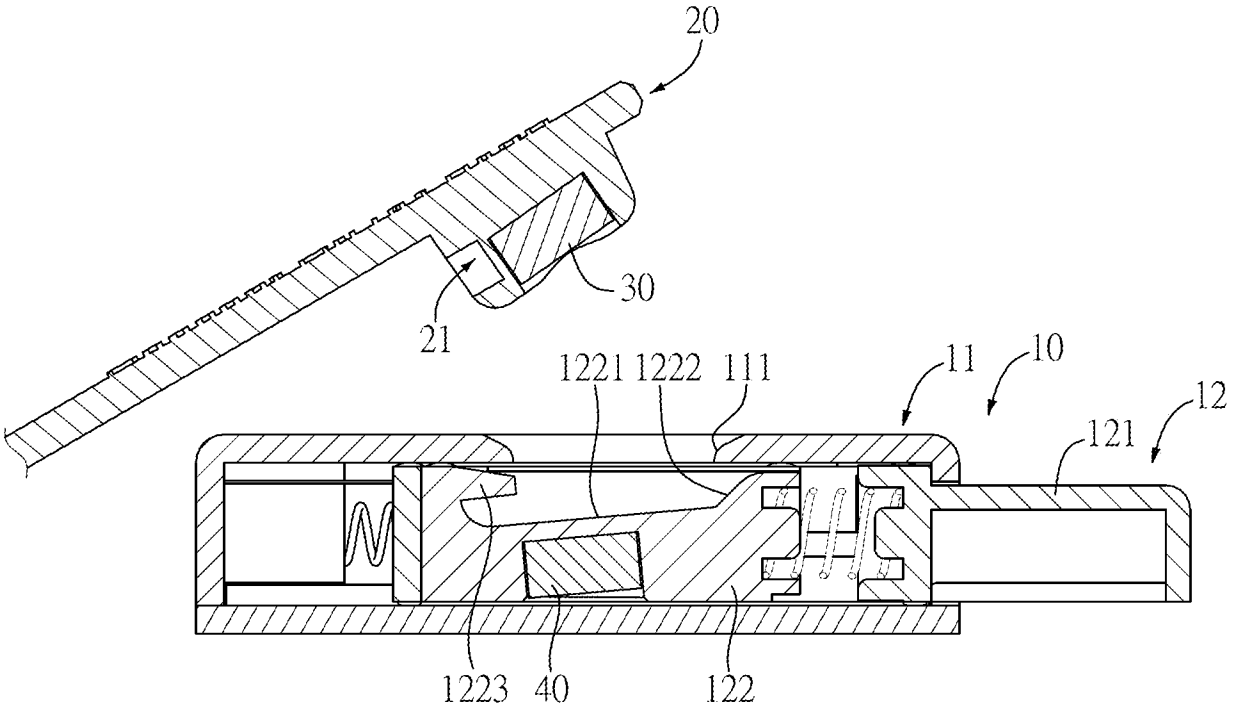
FIG. 3 to FIG. 5 are lateral, sectional, and operational views of the first embodiment of the magnetic buckle device in FIG. 1.
Figure 4:
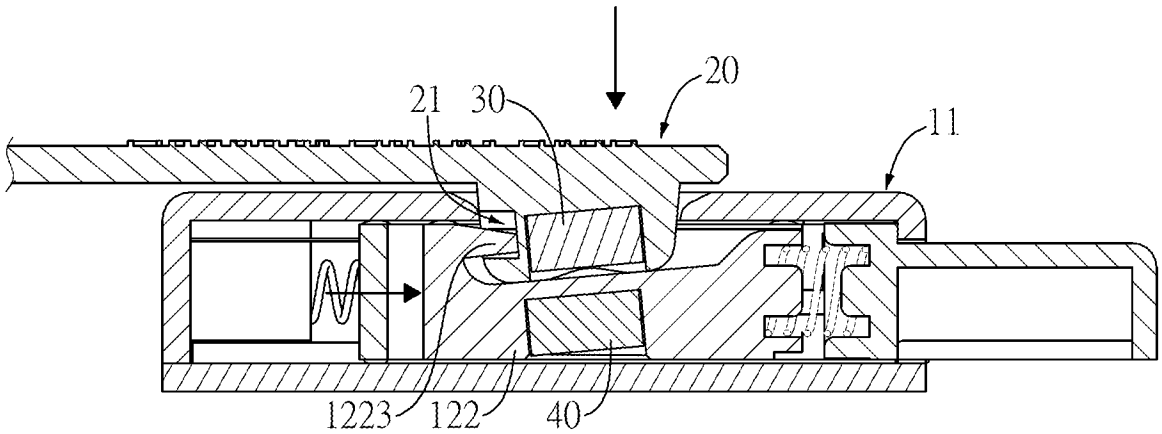

Therefore, when the inserting head 20 is inserted into the first seat 11, the magnetic attraction force between the first component 30 and the second component 40 moves the engaging portion 1223 of the displacement component 122 to engage in the engaging groove 21 of the inserting head 20, and thus the buckle main body 10 enters the engaged state (see FIG. 3 and FIG. 4). Because the engaging portion 1223 of the displacement component 122 is not located on an inserting route of the inserting head 20 before the inserting head 20 is inserted into the insertion hole 111 of the first seat 11, the inserting head 20 may be inserted without any obstruction, which decreases the force needed to insert the inserting head 20.

Figure 5:
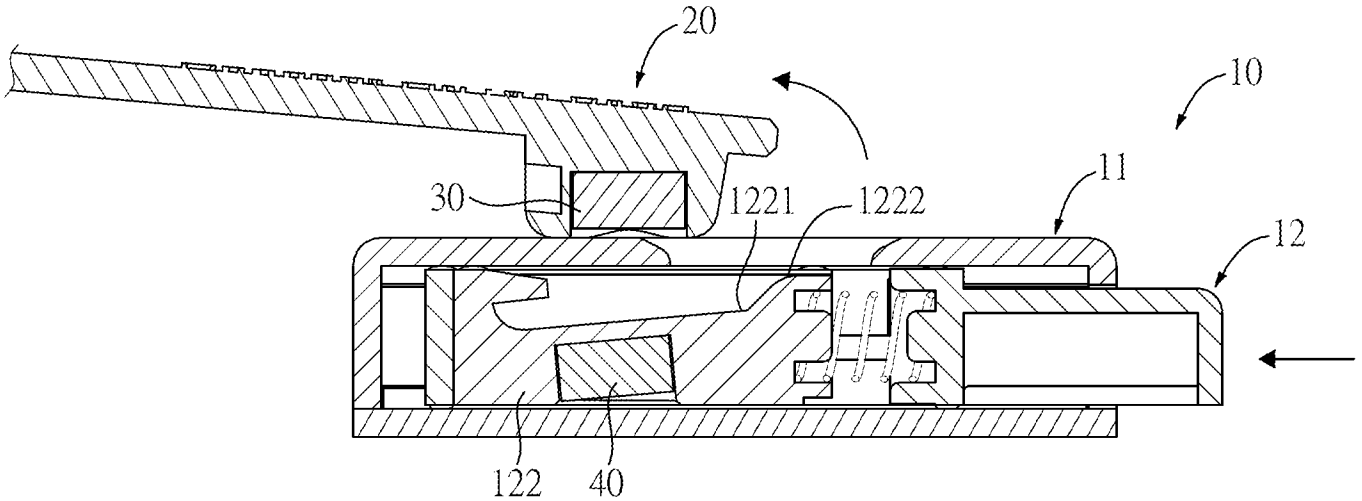

To unlock the magnetic buckle device, the second seat 12 is pushed and the abutting surface 1221 and the tilting-abutting portion 1222 of the second seat 12 will obliquely move the inserting head 20 out of the buckle main body 10 (e.g. out of the first seat 11). Then, after moving out, the inserting head 20 is attracted by the second component 40 of the second seat 12 to attach to the buckle main body 10 (e.g. to the first seat 11) as shown in FIG. 5.

Figure 6:
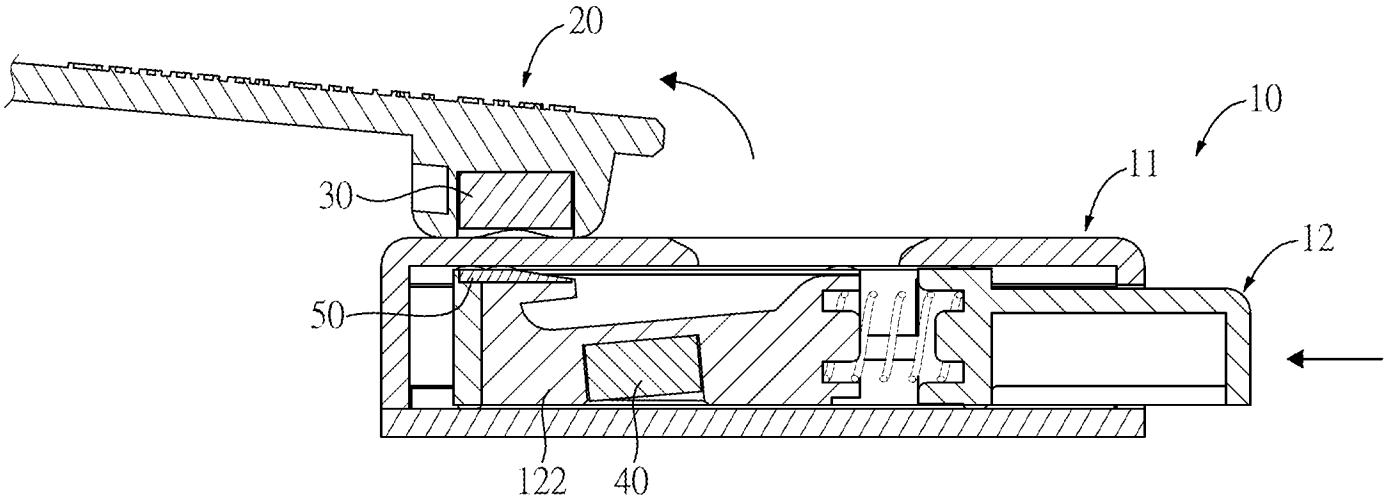
FIG. 6 is a lateral and sectional view of a magnetic buckle device in accordance with a second embodiment of the present invention.

Please refer to FIG. 6. The second embodiment of the magnetic buckle device of the present invention is in a configuration that unlocks via moving and is attracted by the third component. In the second embodiment, the third component 50 is mounted on the second seat 12. Precisely, the third component 50 is mounted on the displacement component 122 of the second seat 12, and further is next to the second component 40 along an opening direction. Thus, after the second seat 12 is pushed along the opening direction to unlock, the inserting head 20 and the first component 30 will be changed to be attracted by the third component 50 to attach to the buckle main body 10 (e.g. to the first seat 11).

Please refer to FIG. 7 to FIG. 9. The third embodiment of the magnetic buckle device of the present invention is in a configuration that unlocks via moving and is attracted by the third component. In the third embodiment, the third component 50 is mounted on the first seat 11. Precisely, the third component 50 is mounted on a bottom surface of a top plate of the first seat 11 (i.e. an inner surface of the first seat 11 that faces the second seat 12). Thus, after the second seat 12 is pushed to unlock, the inserting head 20 and the first component 30 are attracted by the third component 50 to attach to the top plate of the first seat 11.

Moreover, another feature of the third embodiment is that: the magnetic buckle device has two said inserting heads 20 and two said second seats 12. Still another feature of the third embodiment is that: the magnetic buckle device comprises a controlling assembly 60 that selectively prevents one of the second seat 12 and the first seat 11 from moving or rotating with respect to the other and thereby prevents the magnetic buckle device from unlocking (preferably, via a rotated component 61 and a transmitting component 62 or a lock core and a transmitting component 62). Besides, each one of the second seats 12 may be linked to the other second seat 12 and moved synchronously, which also prevents the other second seat 12 from moving or rotating with respect to the first seat 11 (via a wheel 13 preferably). Further, the controlling assembly 60 may be capable of directly controlling the two second seats 12 to move or rotate with respect to the first seat 11.

Finally, in the third embodiment, the first seat 11 has a stopping portion 112 to prevent the inserting head 20 from moving along with the second seat 12, such that the inserting head 20 looks like popping out.

Please refer to FIG. 10 to FIG. 18. The fourth embodiment of the magnetic buckle device of the present invention is in a configuration that unlocks via rotating and is attracted by the third component. In the fourth embodiment, the first seat 11 of the buckle main body 10 is an upper lid and the second seat 12 is a bottom seat, and during unlocking, the second seat 12 (i.e. the bottom seat) is static and the first seat 11 (i.e. the upper lid) is rotated.

In this embodiment, the second seat 12 also has a base body 121 and at least one displacement component 122. Therefore, after the inserting head 20 is inserted, the second component 40 on the displacement component 122 can move the displacement component 122 to engage with the inserting head 20, and thereby the buckle main body 10 enters the engaged state (see FIG. 13, FIG. 14, FIG. 17, and FIG. 18); it is not limited thereto, and the second seat 12 may not be divided into the base body 121 and the displacement component 122 but is a simple bottom seat instead.

Besides, in the fourth embodiment, the magnetic buckle device has three inserting heads 20 and three displacement components 122 and each inserting head 20 cooperates with a respective one of the displacement components 122. The numbers of the inserting heads 20 and the displacement components 122 are not limited thereto; in another embodiment, the magnetic buckle device may have only one inserting head 20 and only one displacement component 122 cooperating with each other.

Figure 14:
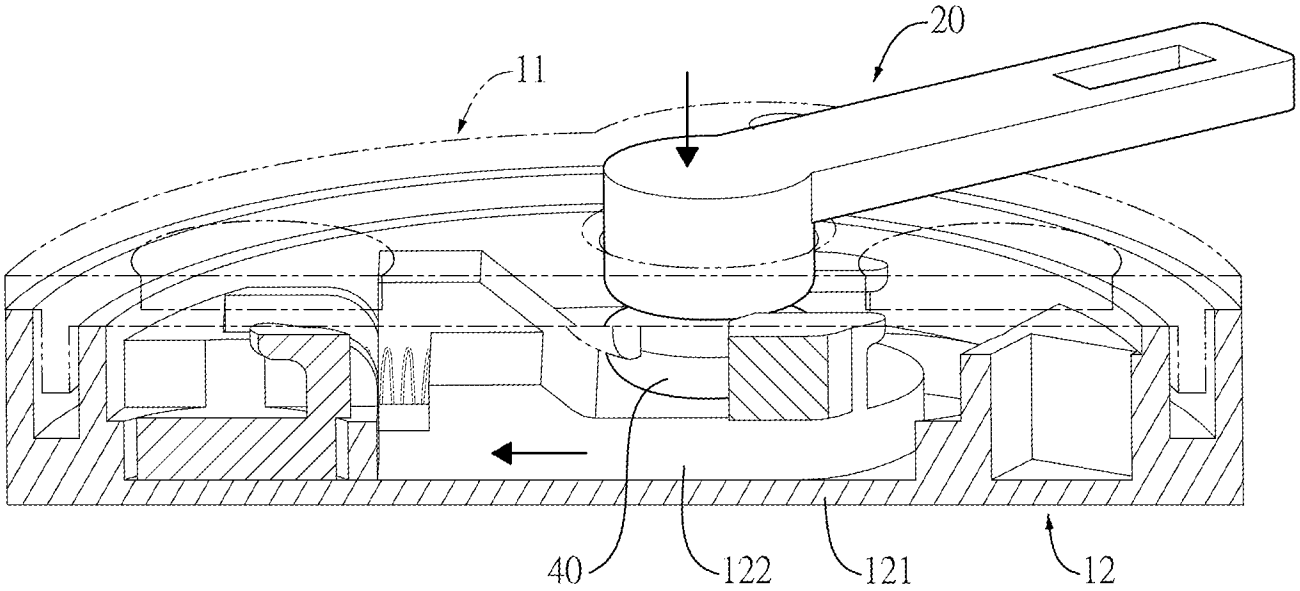
Figure 15:
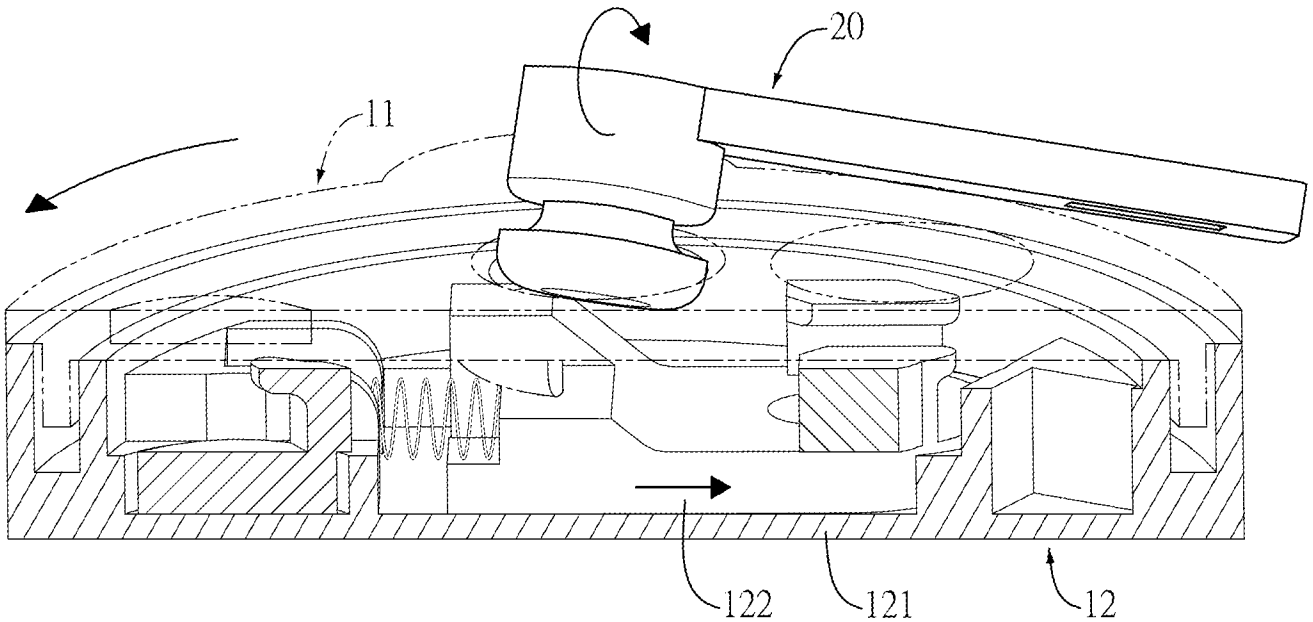
Figure 16:
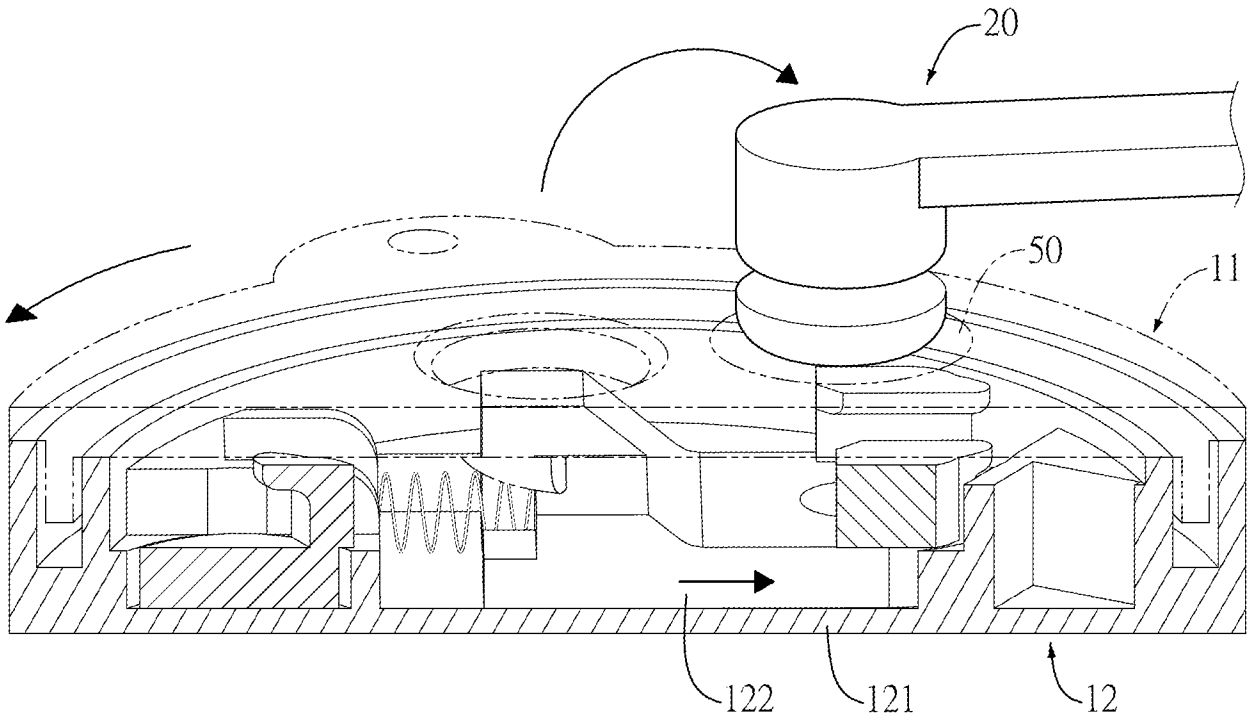
Figure 17:
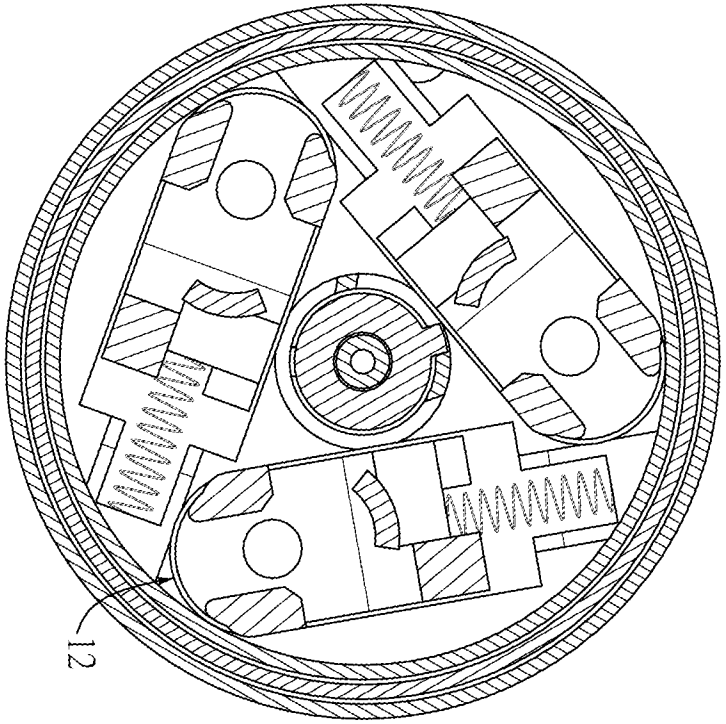
FIG. 17 and FIG. 18 are top, sectional, and operational views of the fourth embodiment of the magnetic buckle device in FIG. 10, showing an inserting head is inserted.
Figure 18:
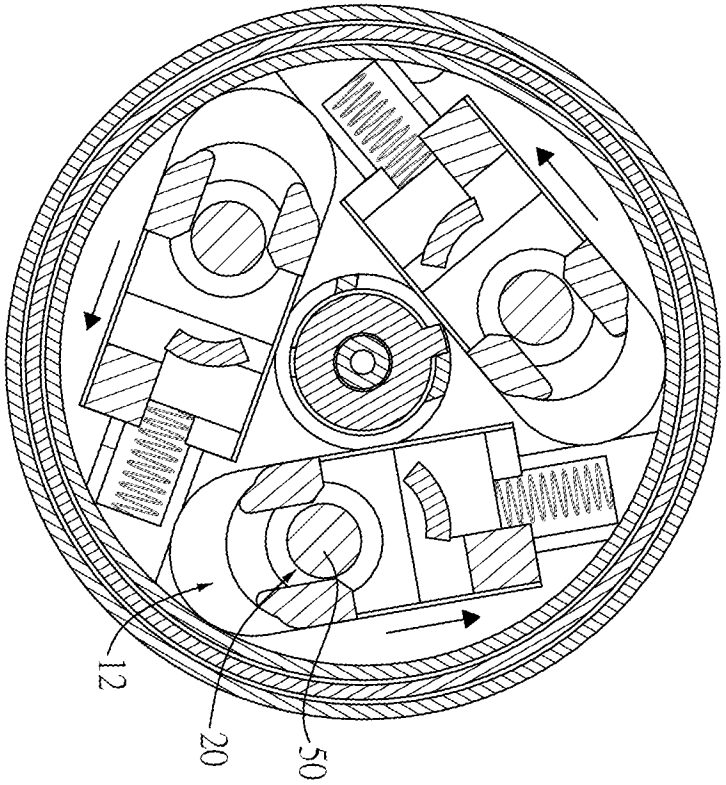

To unlock the magnetic buckle device, the first seat 11 (i.e. the upper lid) is rotated to pass through the first seat 11 (i.e. the upper lid) and the inserting head 20 is rotated along with the first seat 11, which is equivalent to that the inserting head 20 is moved along the displacement component 122 of the second seat 12 and pushed by the tilting-abutting portion 1222 to tilt up, such that the inserting head 20 is pushed out of the first seat 11 (i.e. the upper lid) as shown in FIG. 14 and FIG. 15. Then, the inserting head 20 is attracted by the third component 50, which is located on the top surface of the top plate of the first seat 11 (i.e. the upper lid), to attach to the upper plate of the first seat 11. Said top surface is the outer surface of the first seat 11 that is away from the second seat 12 (see FIG. 15 and FIG. 16). Besides, in the fourth embodiment, the means of rotating may be changed to attraction by the second component; in other words, without the third component, and the inserting head is attracted by the second component to attach to the buckle main body.

Figure 11:
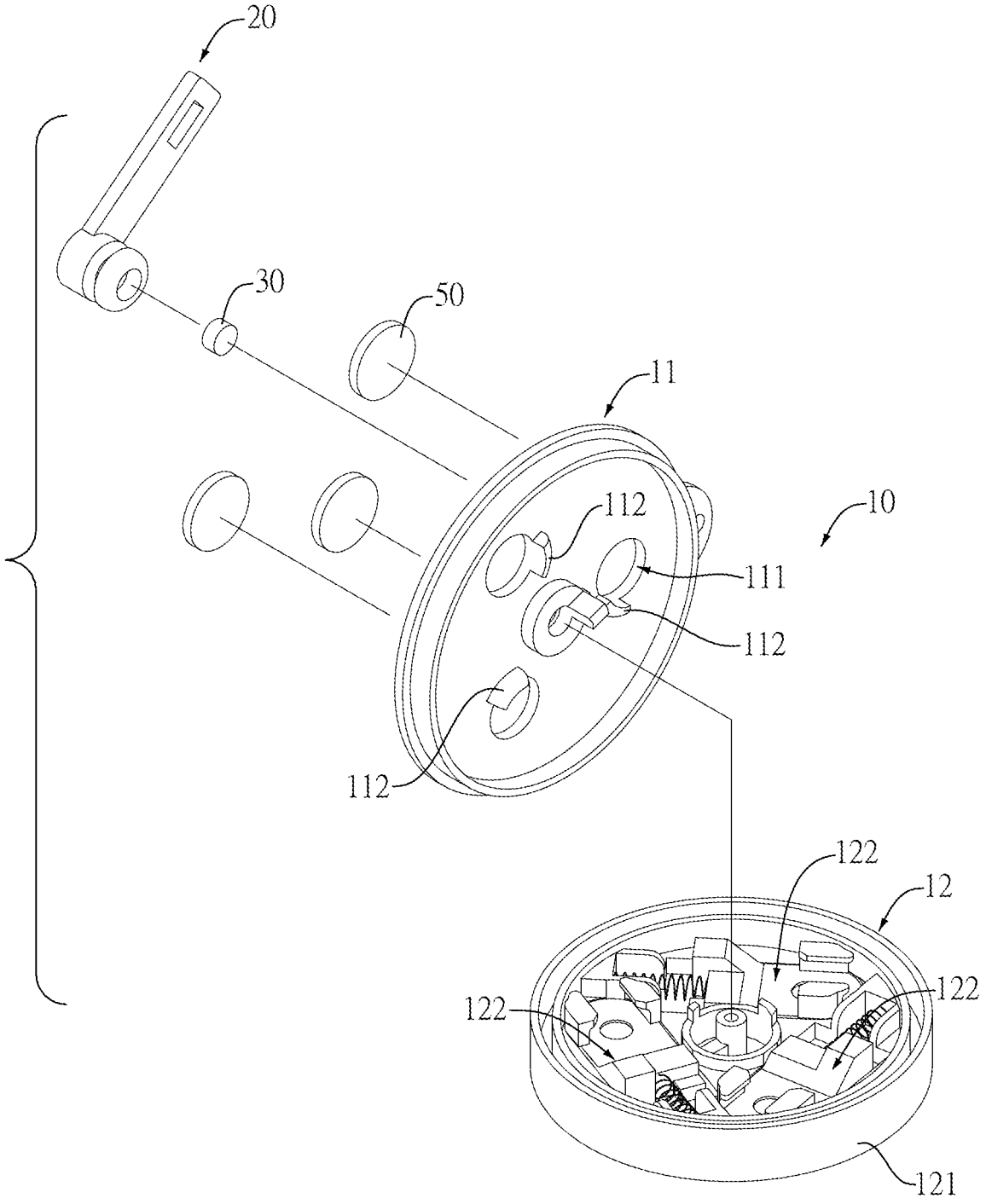
FIG. 11 and FIG. 12 are exploded views of the fourth embodiment of the magnetic buckle device in FIG. 10.
Figure 12:
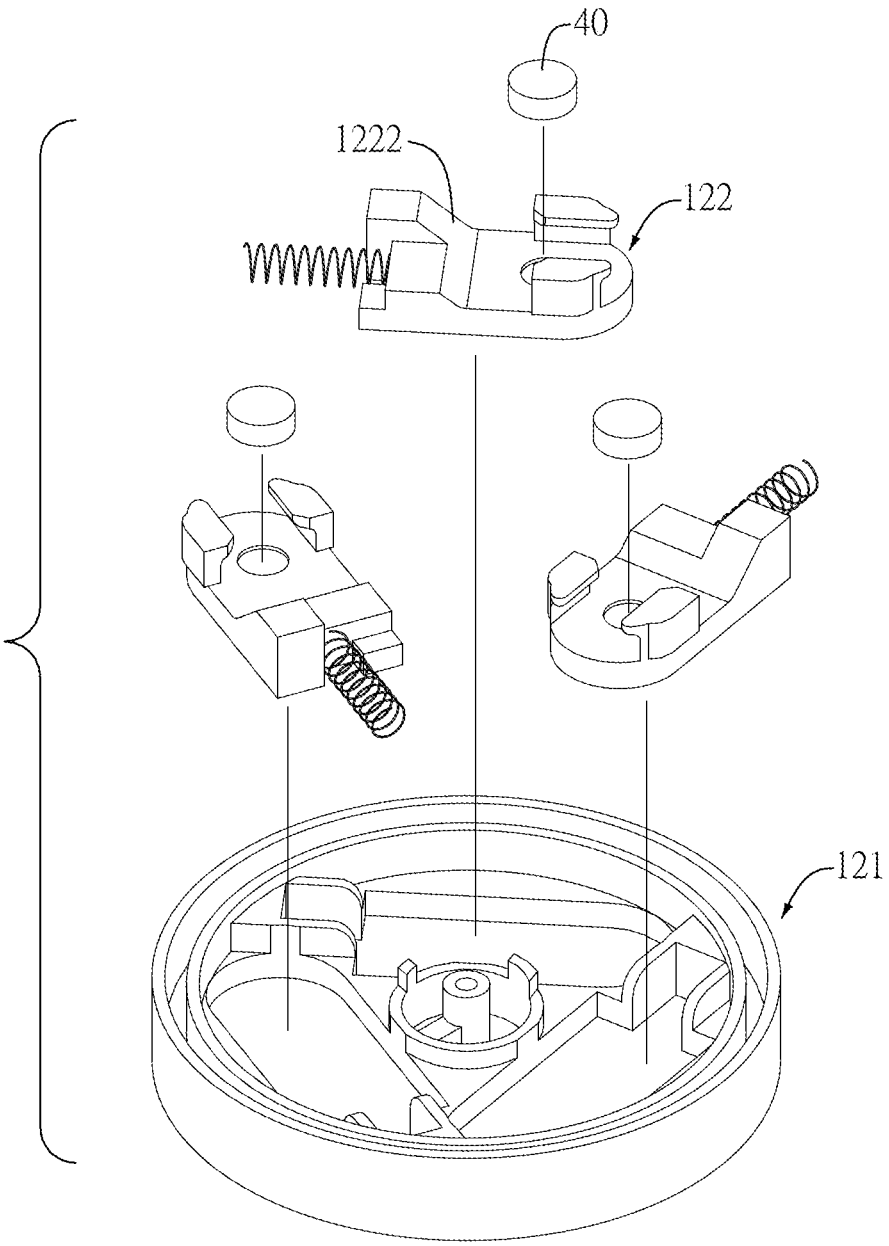
Figure 13:
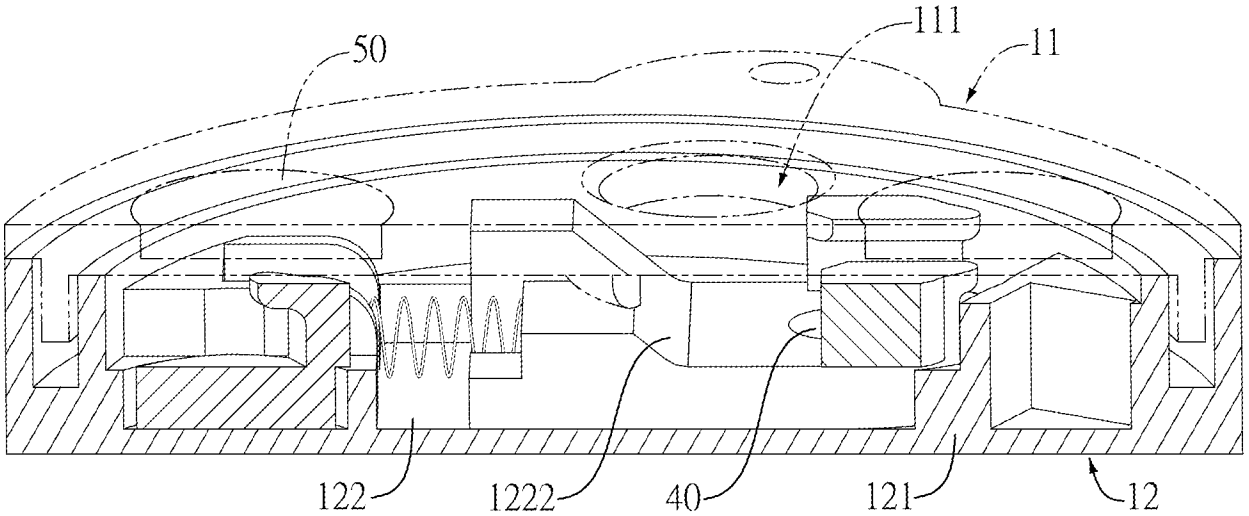
FIG. 13 to FIG. 16 are sectional and operational views of the fourth embodiment of the magnetic buckle device in FIG. 10.

Besides, the first seat 11 may comprise a stopping portion 112. The stopping portion 112 protrudes out from an edge of the insertion hole 111, preferably toward the second seat 12 as shown in FIG. 11. Therefore, during rotation of the first seat 11 (i.e. the upper lid), the stopping portion 112 can assist in rotating the inserting head 20 by the first seat 11.

Figure 19:
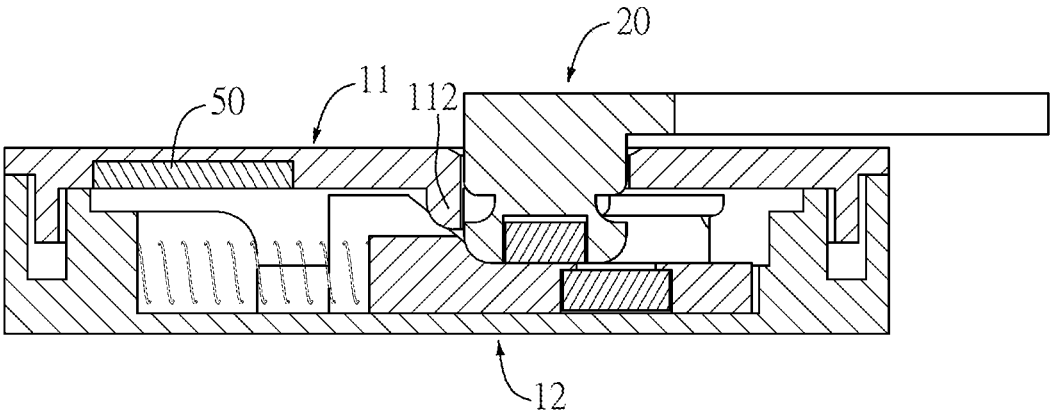
FIG. 19 is a lateral and sectional view of a magnetic buckle device in accordance with a fifth embodiment of the present invention.

Please refer to FIG. 19. The fifth embodiment of the magnetic buckle device of the present invention is in a configuration that unlocks via rotating and via attraction by the third component. In the fifth embodiment, which is similar to the fourth embodiment, the third component 50 is mounted on the bottom surface of the top plate of the first seat 11 (i.e. the upper lid). Said surface is an inner surface of the first seat 11 that faces the second seat 12.

Figure 20:
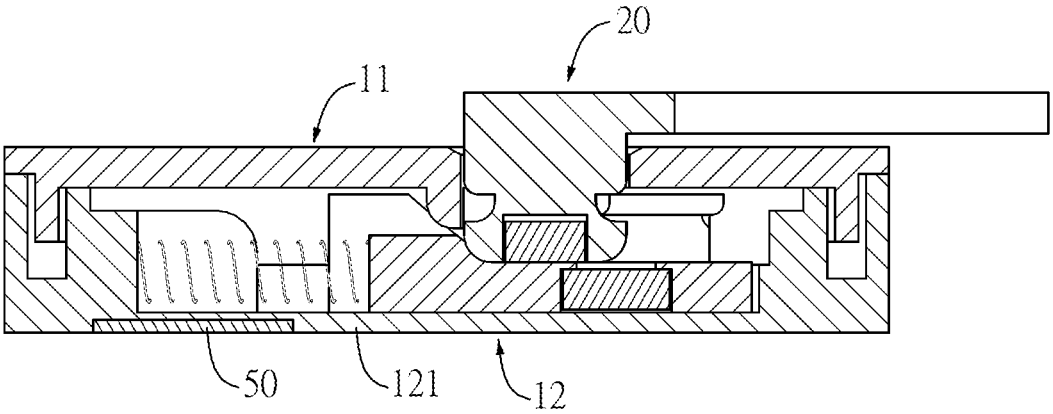
FIG. 20 is a lateral and sectional view of a magnetic buckle device in accordance with a sixth embodiment of the present invention.

Please refer to FIG. 20. The sixth embodiment of the magnetic buckle device of the present invention is in a configuration that unlocks via rotating and via attraction by the third component. In the sixth embodiment, which is similar to the fourth embodiment, the third component 50 is mounted on the base body 121 of the second seat 12 (i.e. the bottom seat), which also attracts the inserting head 20 to the top plate of the first seat 11.

To lock the magnetic buckle device, the inserting head (a zipper head for example) is close to the insertion hole of the buckle main body, and thus the magnetic attraction force between the first component on the inserting head and the second component on the buckle main body may provide a guiding effect. Therefore, the inserting head is capable of getting further closer to the insertion hole of the buckle main body to be inserted into the insertion hole, which assists in inserting the inserting head. Then, after the inserting head is inserted to a predetermined position, the magnetic attraction force between the first component and the second component can assist in keeping the buckle main body in the engaged state.

To unlock the magnetic buckle device, when the buckle main body is switched to the disengaged state and the inserting head is moved out of the buckle main body, the magnetic attraction force between the first component and the second component or between the first component and the third component on the buckle main body can attract the inserting head to attach to the buckle main body, which prevents the inserting head, after moved out, form moving arbitrarily. Therefore, the user does not have to find the inserting head to relock the buckle device.

Even though numerous characteristics and advantages of the present invention have been set forth in the foregoing description, together with details of the structure and features of the invention, the disclosure is illustrative only.

Changes may be made in the details, especially in matters of shape, size, and arrangement of parts within the principles of the invention to the full extent indicated by the broad general meaning of the terms in which the appended claims are expressed.

What is claimed is:

1. A magnetic buckle device comprising:

a buckle main body having an engaged state and a disengaged state;

an inserting head configured to be inserted into the buckle main body along an engaging direction such that the buckle main body enters the engaged state; when the buckle main body is switched to the disengaged state, the buckle main body moves the inserting head out of the buckle main body;

a first component mounted on the inserting head;

a second component mounted on the buckle main body; wherein when the inserting head is inserted into the buckle main body along the engaging direction, a magnetic attraction force is generated between the first component and the second component to assist in keeping the buckle main body in the engaged state; when the buckle main body is switched to the disengaged state and moves the inserting head out of the buckle main body, the inserting head is attached onto the buckle main body by the magnetic attraction force between the first component and the second component.

2. The magnetic buckle device as claimed in claim 1, wherein the buckle main body comprises:

a first seat and a second seat combined together, the first seat comprising:

an insertion hole; the inserting head capable of being inserted through the insertion hole of the first seat along the engaging direction and into the second seat, and thereby the buckle main body entering the engaged state; the first seat and the second seat capable of moving or rotating with respect to each other to switch the buckle main body to the disengaged state; in the disengaged state, the magnetic attraction force between the first component and the second component attracting the inserting head to attach to the first seat.

3. The magnetic buckle device as claimed in claim 2, wherein when the first seat and the second seat are moved or rotated with respect to each other such that the buckle main body is switched to the disengaged state, a force is generated by the second seat to move the inserting head obliquely out of the buckle main body.

4. The magnetic buckle device as claimed in claim 2, wherein the first seat comprises:

a stopping portion; when the first seat and the second seat are moved or rotated with respect to each other such that the buckle main body is switched to the disengaged state, the stopping portion abuts the inserting head along with the relative moving or rotating of the first seat and the second seat.

5. The magnetic buckle device as claimed in claim 1, wherein when the buckle main body is switched to the disengaged state, the inserting head is moved obliquely out of the buckle main body and attached to the buckle main body.

6. A magnetic buckle device comprising:

a buckle main body having an engaged state and a disengaged state;

an inserting head configured to be inserted into the buckle main body along an engaging direction such that the buckle main body enters the engaged state; when the buckle main body is changed to the disengaged state, the buckle main body moves the inserting head out of the buckle main body;

a first component mounted on the inserting head;

a second component mounted on the buckle main body; when the inserting head is inserted into the buckle main body along the engaging direction, a magnetic attraction force is generated between the first component and the second component to assist in keeping the buckle main body in the engaged state;

a third component mounted on the buckle main body; when the buckle main body is switched to the disengaged state such that the inserting head is moved out of the buckle main body, a magnetic attraction force is generated between the first component and the third component to attach the inserting head to the buckle main body.

7. The magnetic buckle device as claimed in claim 6, wherein the buckle main body comprises:

a first seat and a second seat combined together, the first seat comprising:

an insertion hole; the inserting head capable of being inserted through the insertion hole of the first seat along the engaging direction and into the second seat, and thereby the buckle main body entering the engaged state; the first seat and the second seat capable of moving or rotating with respect to each other to switch the buckle main body to the disengaged state; in the disengaged state, the magnetic attraction force between the first component and the third component attracting the inserting head to attach to the first seat.

8. The magnetic buckle device as claimed in claim 7, wherein the third component is mounted on the first seat.

9. The magnetic buckle device as claimed in claim 8, wherein the third component is mounted on a surface of the first seat, and said surface is an outer surface of the first seat that is away from the second seat.

10. The magnetic buckle device as claimed in claim 8, wherein the third component is mounted on a surface of the first seat, and said surface is an inner surface of the first seat that faces the second seat.

11. The magnetic buckle device as claimed in claim 7, wherein the third component is mounted on the second seat.

* * * * *